US006988646B2

(12) United States Patent
White

(10) Patent No.: US 6,988,646 B2
(45) Date of Patent: Jan. 24, 2006

(54) GOLF TEE HOLDER

(76) Inventor: Stephen M. White, 95 Judd Duvall La., Franklin, NC (US) 28734

( * ) Notice: Subject to any disclaimer, the term of this patent is extended or adjusted under 35 U.S.C. 154(b) by 0 days.

(21) Appl. No.: 10/847,377

(22) Filed: May 18, 2004

(65) Prior Publication Data

US 2004/0262344 A1 Dec. 30, 2004

Related U.S. Application Data

(60) Provisional application No. 60/482,869, filed on Jun. 27, 2003.

(51) Int. Cl.
*A45C 15/00* (2006.01)

(52) U.S. Cl. ..... 224/576; 224/197; 224/668; 224/269; 224/918; 206/38; 206/315.1

(58) Field of Classification Search ..... 224/269, 224/918, 576, 584, 197, 223, 666, 668, 242, 224/246, 249, 251; 206/3, 38, 37.4, 315.1, 206/379, 579
See application file for complete search history.

(56) References Cited

U.S. PATENT DOCUMENTS 1,744,104 A * 1/1930 Carroll ..... 206/315.1
2,112,339 A 3/1938 Kasparek
2,636,751 A * 4/1953 Carlson ..... 281/45
4,498,615 A 2/1985 Johnson
4,745,662 A * 5/1988 Chang ..... 24/67.7
5,050,830 A * 9/1991 Hall ..... 248/205.2
5,158,179 A * 10/1992 Gosselin ..... 206/315.1
5,172,839 A 12/1992 Frisbie
D349,549 S * 8/1994 DeMichele ..... D3/221

* cited by examiner

*Primary Examiner*—Stephen K. Cronin

(74) *Attorney, Agent, or Firm*—Richard C. Litman

(57) ABSTRACT

The golf tee holder is in the form of a generally flat corrugated plastic body of a selected shape having a longitudinal axis. The corrugation being in the form of walls between the front panel and back panel of the plastic body that extend in a direction traverse the longitudinal axis of the plastic body and form channels between the panels opening along both side edges of the body. Each channel is sized to resiliently retain the shaft of a conventional golf tee during the jostling encountered during a round of golf. An eyelet is provided adjacent one end of the body for receiving a hook or ring for attaching the body to a golfers belt, a golf bag, of any other suitable golf equipment such as a golf cart key for example. A clipboard-type clamp is provided for securing a golf scorecard and a marking device to the holder.

13 Claims, 4 Drawing Sheets

GOLF TEE HOLDER

CROSS-REFERENCE TO RELATED APPLICATION

This application claims the benefit of U.S. Provisional Patent Application Ser. No. 60/482,869, filed Jun. 27, 2003.

BACKGROUND OF THE INVENTION

1. Field of the Invention

The present invention relates to carriers, and more specifically, the invention relates to holders for safely carrying an easily accessible supply of golf tees around a golf course.

2. Description of the Related Art

It is a common practice for golfers to carry a supply of golf tees with them as they cover a golf course. A number of devices have been designed heretofore for the purpose of conveniently carrying golf tees in a safe and quickly accessible fashion on a golfer's person or equipment. For example, U.S. Pat. No. 5,172,839 issued Dec. 22, 1992 to Frisbie teaches a golf tee holder in the form of a group of short flexible tubes that receive the shanks of standard golf tees in a gentle force fit. The tubes are gathered into a cluster and bound with copper wire and inserted within a cap including a snap hook or key ring at the closed end of the cap. In addition, the tubes can be integrally molded with a more rigid triangular plastic body with the tubes extending on parallel axes from the longest side of the triangular plastic body for receiving the tees. A strap is provided on the body for attaching the device over the belt of a user.

In the U.S. Pat. No. 2,112,339 issued Mar. 29, 1938 to Kasparek a rubber support body is provided with pairs of holes for receiving the stem of golf tees. A strap for securing the device to a belt, strap, or handle is provided. The strap is integrally formed with the body and includes an opening through which the body can pass to form a loop.

U.S. Pat. No. 4,498,615 issued Feb. 12, 1985 to Johnson teaches a method of removably transporting golf tees wherein the golf tee holder is in the form of a pair flexible VELCRO™ strips. One strip is adhesively attachable to a person's clothing, golf bag, cart or other objects. Golf tees are pushed between the strips where they are held until removed for use.

None of the above inventions and patents, taken either singly or in combination, is seen to describe the instant invention as claimed. Thus a golf tee holder solving the aforementioned problems is desired.

SUMMARY OF THE INVENTION

The golf tee holder according to the present invention is provided holder in the form of a generally flat corrugated plastic body of a selected shape having a longitudinal axis. The corrugation of the body being in the form of walls connected between the front panel and back panel of the plastic body that extend in a direction traverse the longitudinal axis of the plastic body. The walls form channels there between that open along both side edges of the body. Each channel is sized to resiliently retain the shaft of a conventional golf tee. An eyelet is provided adjacent one end of the body for receiving a hook or ring for attaching the body to the belt of a golfer, a golf bag, or any other suitable golf equipment such as a golf cart key for example. In a modification of the golf tee holder a clipboard-type clamp is affixed thereto in place of the eyelet for further securing a golf scorecard and writing implement to the holder. The hook or ring is received in one of the circular finger tabs of the clamp.

Accordingly, it is a principal object of the invention to provide a golf tee holder having means for attaching the holder to the belt of a golfer, a golf bag, a golf cart key, or other pieces of golf equipment where the golf tees can be readily available for use.

It is another object of the invention to provide a golf tee holder in a variety of ornamental shapes and sizes that securely holds a plurality of golf tees during the jostling encountered during play on a golf course.

It is a further object of the invention to provide a golf tee holder that eliminates the risk of golfers being poked in the finger by the sharp point of a golf tee when retrieving loose tees from a pocket of one's clothing during a round of golf.

It is an additional object of the invention to provide a golf tee holder wherein the means for attaching the holder to a golfer's belt, etc., is provided in the form of a clamp that also conveniently holds a golf scorecard and a writing implement.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
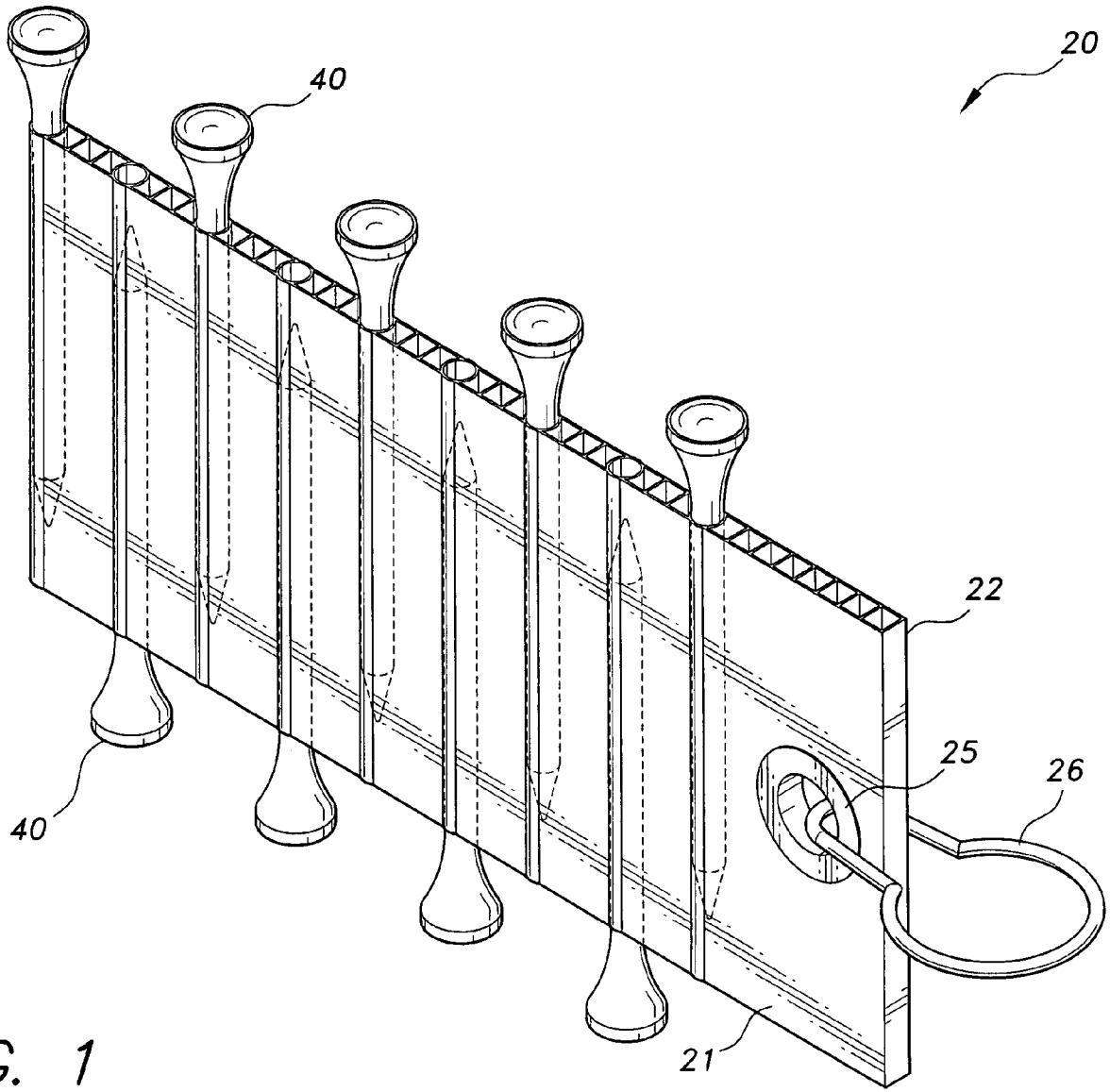
FIG. 1 is an environmental, perspective view of a golf tee holder according to the present invention.

The present invention provides a golf tee holder in the form of a generally flat plastic body 20 that may be cut or stamped from a corrugated sheet into any desired shape. A longitudinal axis of the body 20 traverses the direction of corrugation 30 of the sheet.

The corrugation 30 is preferably in the form of perpendicular walls 23 between the front panel 21 and back panel 22 of the plastic body 20. This arrangement forms channels 24 opening along both side edges of the body 20 for receiving the shafts of conventional golf tees 40.

The plastic material of body 20 is selected such that the walls 23 resiliently retain the shafts of golf tees 40 within the channels during the jostling encountered during rounds on golf courses.

Figure 2:
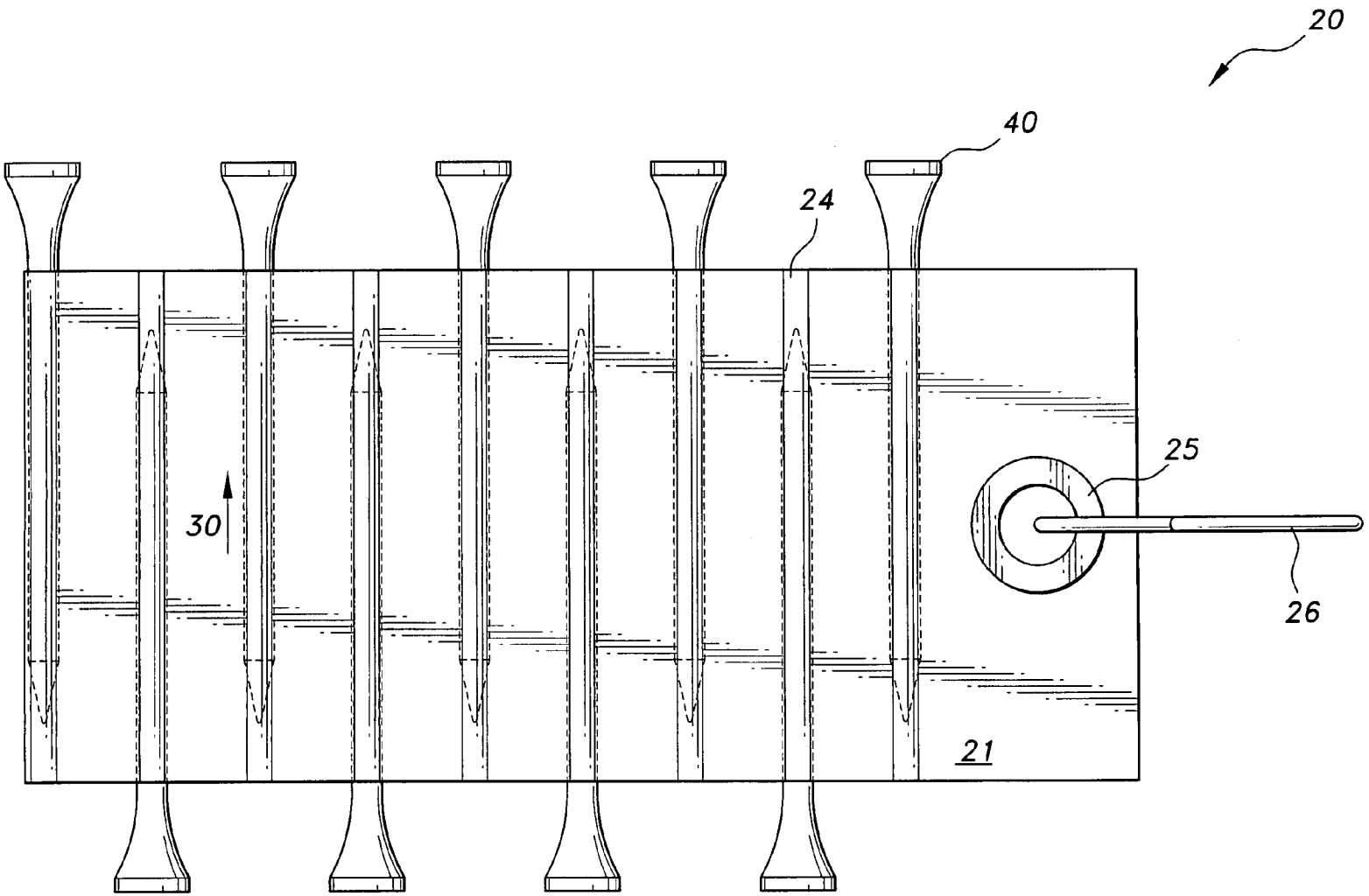
FIG. 2 is a front view of the golf tee holder according to the present invention.
Figure 3:
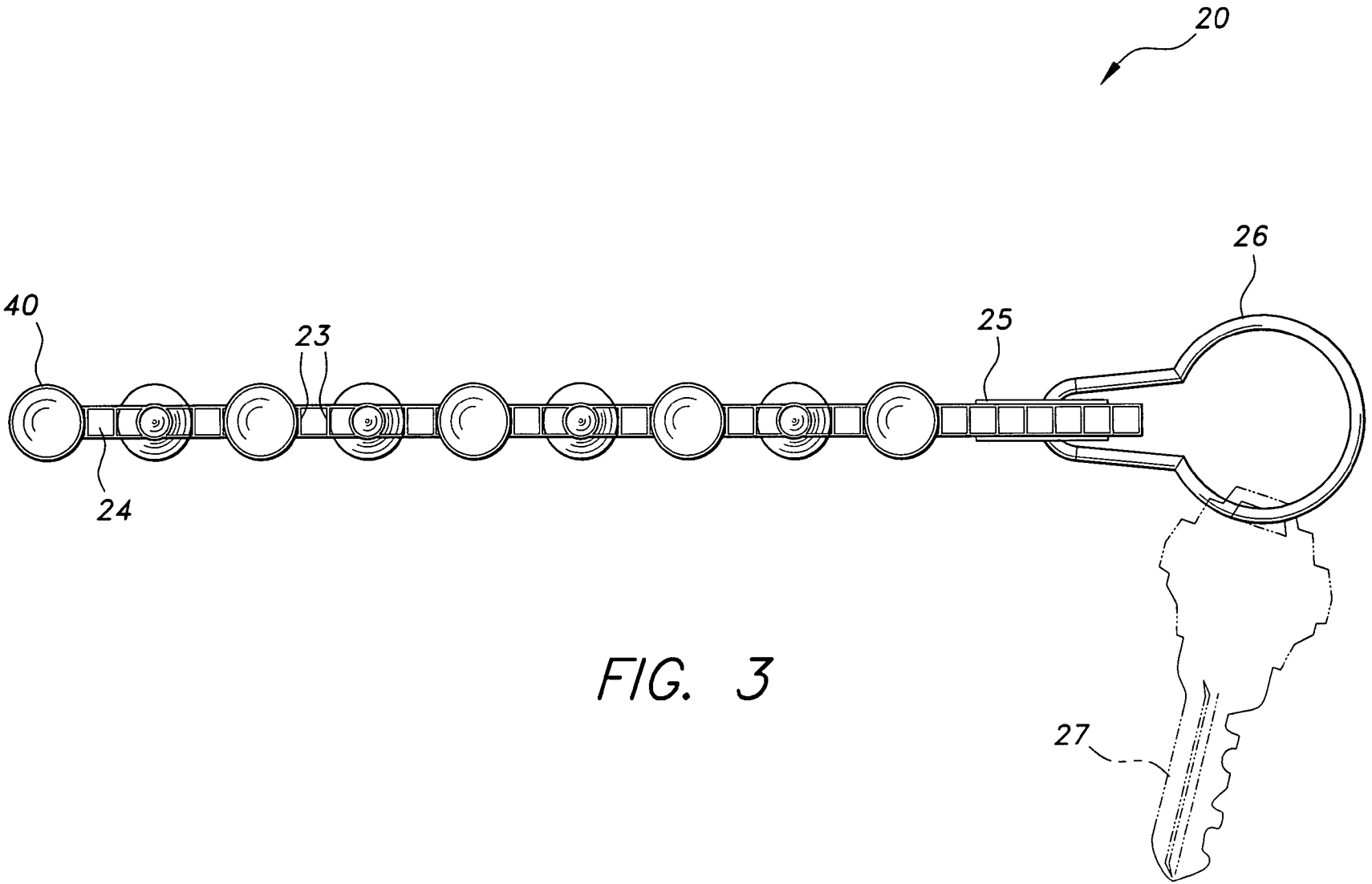
FIG. 3 is a side view of the golf tee holder according to the present invention.

As best seen in FIGS. 2 and 3, an eyelet 25 is provided in the body 20 adjacent one end of the body 20 along the longitudinal axis of the body 20. The eyelet 25 is preferably formed of a suitable metal material. A ring or hook 26 is provided that may be used for attaching holder body 20 to a belt, a golf bag, or any other suitable piece of golf equipment such as a golf cart key 27, as shown by phantom lines in FIG. 3.

The front panel 21 and back panel 22 of body 20 have surfaces suitable for the printing of decorative displays and/or information thereon.

Figure 4:
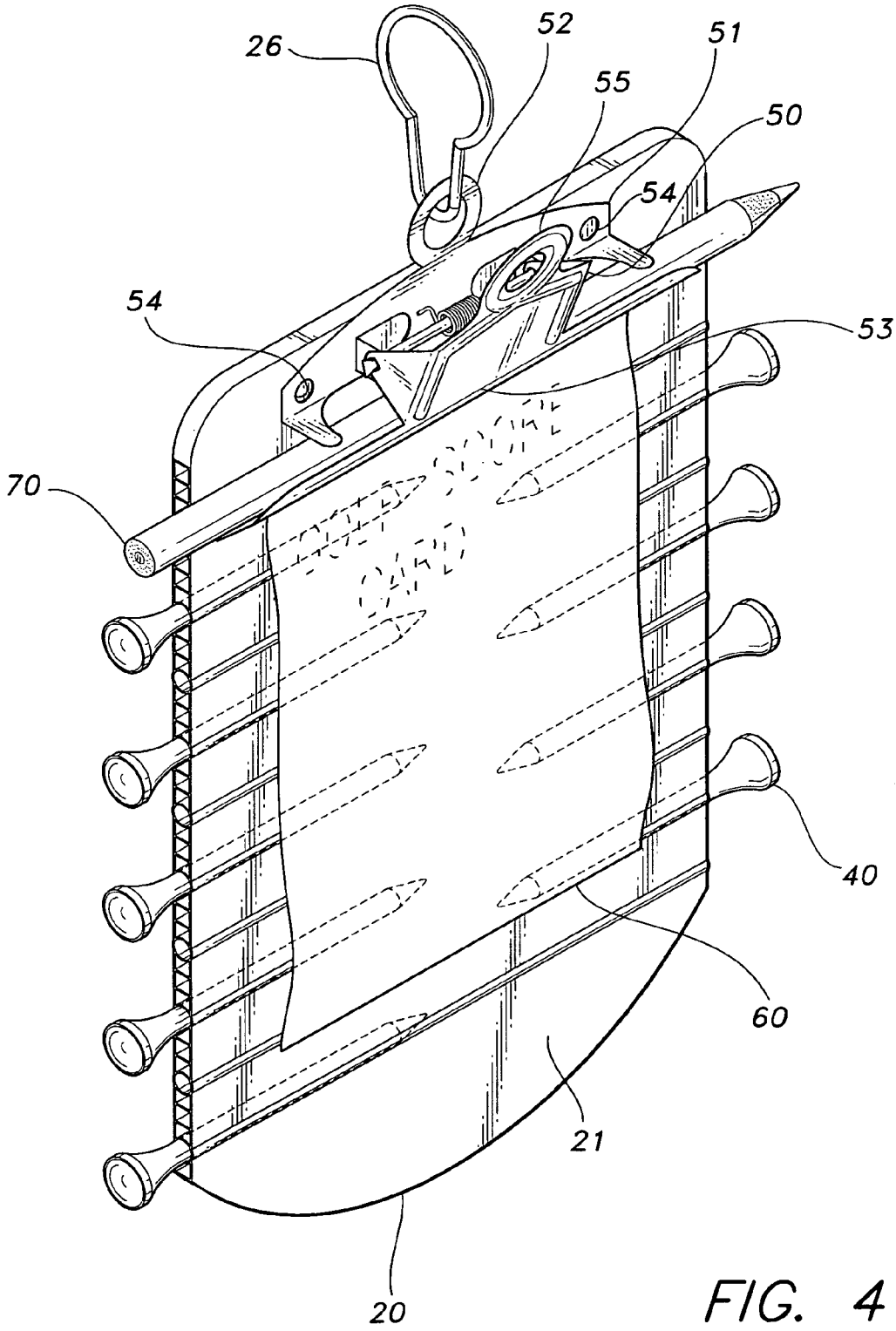
FIG. 4 is a perspective view of the golf tee holder according to the present invention including a clipboard-type clamp for securing a golf scorecard and a writing implement to the holder.

A preferred modification of the golf tee holder is depicted in FIG. 4. A clipboard-type clamp 50 is affixed adjacent one end of the body 20 on front panel 21 instead of eyelet 25 for conveniently securing a golf scorecard 60 and a writing implement 70 such as a pen or pencil to the holder body 20. The clamp 50 preferably in the form of a commercially available type such as the metal "B6" clip available from American Acrylics Inc. of Chicago, Ill. As shown in FIG. 4, clamp 50 includes a base portion 51 and a clamping portion 53 spring-biased towards the base portion 51. Base portion 51 is formed with a loop portion 52 and/or pair of rivet holes 54. Clamping portion 53 is also formed with a loop portion 55. Loop portions 52 and 55 can be engaged by the fingers of a hand to operate the clamp 50. Hook or ring 26 is received within one of the loop portions of the clamp 50. Clamp 50 is preferably secured to holder body 20 by a suitable adhesive bonding process, thermal-bonding process or by rivets. Any suitable and commercially available clips or combination devices for clamping paper and holding a writing implement may replace the above-described clamp.

It is to be understood that the present invention is not limited to the embodiment described above, but encompasses any and all embodiments within the scope of the following claims.

I claim:

1. A golf tee holder, comprising:

a generally flat corrugated plastic body of a selected shape having a longitudinal axis, said plastic body formed of unitary construction;

said body having a front panel, back panel and corrugation between said panels, the direction of corrugation being transverse the longitudinal axis of said plastic body such that channels are formed in said body having openings along both side edges of said body;

an eyelet disposed in said body; and said channels being sized to receive the shaft of a conventional golf tee in said openings.

2. The golf tee holder according to claim 1, wherein said plastic body is formed from a plastic material selected such that the shafts of golf tees may be resiliently retained within the channels during the jostling encountered during rounds on golf courses.

3. The golf tee holder according to claim 1, wherein said corrugation is in the form of perpendicular walls between said front and back panels of said plastic body extending between said side edges of said body.

4. The golf tee holder according to claim 1, wherein said front panel and said back panel have viewing surfaces for receiving a printed display.

5. The golf tee holder according to claim 1, further comprising means for securing said body to a support structure;

wherein said means for securing is selected from the group consisting of a hook and a ring;

whereby the support structure is selected from the group of belts, belt loops, golf bags, or the like.

6. A golf tee holder, comprising:

a generally flat corrugated plastic body of a selected shape having a longitudinal axis;

said body having a front panel, back panel and corrugation between said panels;

said plastic body formed of unitary construction;

wherein the direction of corrugation is transverse the longitudinal axis of said plastic body such that channels are formed in said body having openings along both side edges of said body;

said channels being sized to receive the shaft of a conventional golf tee in said openings;

a clipboard-type clamp secured adjacent one end of said body on said front panel for conveniently securing a golf scorecard and a writing implement to said holder body; and an eyelet, said eyelet being disposed in one of said body and said clamp.

7. The golf tee holder according to claim 6, wherein said clamp is secured to said holder body by one of a suitable adhesive bonding process, a suitable thermal-bonding process and rivets.

8. The golf tee holder according to claim 6, wherein said clamp further includes:

a base portion and a clamping portion spring-biased towards said base portion;

said base portion having a loop portion;

wherein said eyelet is said loop portion;

said clamping portion having a loop portion;

said loop portions being engaged by the fingers of a hand to operate said clamp; and a hook received within one of said loop portions.

9. The golf tee holder according to claim 8, wherein said clamp is secured to said holder body by one of a suitable adhesive bonding process, a suitable thermal-bonding process and rivets.

10. A golf tee holder, comprising:

a generally flat corrugated plastic body of a selected shape having a longitudinal axis;

said plastic body formed of unitary construction;

said body having a front panel, back panel and corrugation between said panels;

the direction of corrugation is transverse the longitudinal axis of said plastic body such that channels are formed in said body having openings along both side edges of said body;

said channels being sized to receive the shaft of a conventional golf tee in said openings;

said plastic body is formed from a suitable plastic material wherein the shafts of golf tees are resiliently retained within said channels during the jostling encountered during rounds on golf courses;

a clipboard-type clamp secured adjacent one end of said body on said front panel for conveniently securing a golf scorecard and a writing implement to said holder body; and an eyelet, said eyelet being disposed in one of said body and said clamp.

11. The golf tee holder according to claim 10, wherein said clamp is secured to said holder body by one of a suitable adhesive bonding process, a suitable thermal-bonding process and rivets.

12. The golf tee holder according to claim 10, wherein said clamp further includes:

a base portion and a clamping portion spring-biased towards said base portion;

said base portion having a loop portion;

wherein said eyelet is said loop portion;

said clamping portion having a loop portion;

said loop portions being engaged by the fingers of a hand to operate said clamp; and a hook received within one of said loop portions.

13. The golf tee holder according to claim 12, wherein said clamp is secured to said holder body by one of a suitable adhesive bonding process, a suitable thermal-bonding process and rivets.

* * * * *